US005271779A

United States Patent [19]

Engsbraten

[11] Patent Number: 5,271,779

[45] Date of Patent: Dec. 21, 1993

[54] MAKING A REDUCED VOLUME STRENGTH BLASTING COMPOSITION

[75] Inventor: Björn Engsbråten, Öbrebro, Sweden

[73] Assignee: Nitro Nobel AB, Gyttorp, Sweden

[21] Appl. No.: 798,956

[22] Filed: Nov. 27, 1991

Related U.S. Application Data

[62] Division of Ser. No. 607,362, Oct. 31, 1990, which is a division of Ser. No. 313,471, Feb. 22, 1989, Pat. No. 4,995,925.

[30] Foreign Application Priority Data

Feb. 22, 1988 [SE] Sweden ..... 8800593

[51] Int. Cl.[5] ..... C06B 21/00

[52] U.S. Cl. ..... 149/109.6; 149/2; 149/46; 149/60

[58] Field of Search ..... 149/109.6, 2, 46, 60

[56] References Cited

U.S. PATENT DOCUMENTS

| | | | |
|---|---|---|---|
| 2,978,947 | 4/1961 | Jeffries | 86/20 |
| 3,068,791 | 12/1962 | Lambert et al. | 102/23 |
| 4,008,108 | 2/1977 | Chrisp | 149/2 |
| 4,111,727 | 9/1978 | Clay | 149/2 |
| 4,181,546 | 1/1980 | Clay | 149/21 |
| 4,195,548 | 4/1980 | Cook et al. | 149/109.6 |
| 4,294,633 | 10/1981 | Clay | 149/2 |
| 4,298,288 | 11/1981 | Weisbrod | 366/20 |
| 4,443,109 | 4/1984 | Watts | 366/134 |
| 4,511,414 | 4/1985 | Matsui et al. | 149/109.6 |
| 4,525,225 | 6/1985 | Cechanski | 149/2 |
| 4,526,633 | 7/1985 | Lawrence et al. | 149/109.6 |
| 4,543,136 | 9/1985 | Edamura et al. | 149/2 |
| 4,543,137 | 9/1985 | Edamuta et al. | 149/2 |
| 4,555,278 | 11/1985 | Cescon et al. | 149/2 |
| 4,566,920 | 1/1986 | Libouton et al. | 149/2 |
| 4,585,496 | 4/1986 | Honeyman et al. | 149/2 |
| 4,614,146 | 9/1986 | Ross et al. | 149/109.6 |
| 4,615,751 | 10/1986 | Smith et al. | 149/2 |
| 4,619,721 | 10/1986 | Cescon et al. | 149/2 |
| 4,714,503 | 12/1987 | Cescon et al. | 149/2 |
| 4,732,627 | 3/1988 | Cooper et al. | 149/109.6 |
| 4,737,207 | 4/1988 | Ehrnström et al. | 149/2 |
| 4,756,779 | 7/1988 | Matts | 149/109.6 |
| 4,830,687 | 5/1989 | Mullay et al. | 149/2 |
| 4,836,870 | 6/1989 | Cunningham et al. | 149/109.6 |
| 4,872,929 | 10/1989 | Mullay | 149/46 |
| 4,875,950 | 10/1989 | Waldock et al. | 149/2 |
| 4,936,933 | 6/1990 | Yabsley et al. | 149/109.6 |
| 4,948,440 | 8/1990 | Cribb et al. | 149/109.6 |

FOREIGN PATENT DOCUMENTS

| | | |
|---|---|---|
| 0256447 | 2/1988 | European Pat. Off. . |
| 1182566 | 11/1964 | Fed. Rep. of Germany . |
| 1306546 | 2/1973 | United Kingdom . |
| 1311077 | 3/1973 | United Kingdom . |
| 1374940 | 11/1974 | United Kingdom . |

*Primary Examiner*—Edward A. Miller

*Attorney, Agent, or Firm*—Burns, Doane, Swecker & Mathis

[57] ABSTRACT

A blasting composition of reduced volume strength relative to straight ammonium nitrate/fuel oil (ANFO) compositions, containing particulate oxidizer salt, particulate inert and/or density reducing filler and optionally a fuel for modifying the oxygen balance. The composition contains a viscous water-in-oil type emulsion, having a continuous fuel phase and a discontinuous aqueous phase of oxidizing salts, in an amount sufficient for improving adherence between the particulate oxidizer salt and the particulate filler, but insufficient for filling out the interstices between the particulate oxidizer salt and the particulate filler.

15 Claims, No Drawings

MAKING A REDUCED VOLUME STRENGTH BLASTING COMPOSITION

This application is a divisional, of application Ser. No. 07/607,362, filed Oct. 31, 1990, in turn a divisional of application Ser. No. 07/313,471, filed Feb. 22, 1989, now U.S. Pat. No. 4,995,925.

TECHNICAL FIELD

The present invention relates to a blasting composition of reduced strength relative to straight ammonium nitrate/fuel oil (ANFO) compositions. More particularly the invention relates to compositions of this kind containing a particulate oxidizer salt, a particulate inert and/or density reducing filler and, optionally, a fuel for modifying the oxygen balance.

BACKGROUND

In many blasting applications it is desirable to have an explosive of reduced and variable bulk strength. In driving tunnels or galleries careful blasting of the contour holes will give a substantially undamaged rock face with strongly reduced needs for subsequent repair and support work such as bolting, gunniting, concrete reinforcement etc. and the final profile will be true the design size. Similar considerations araise in underground mining and stoping as well as in bench blasting to limit production of fines to meet certain after-processing constraints.

Although numerous closely spaced bore-holes can be used to produce smooth fracture planes, the method is limited by practical and economical reasons and conventionally careful blasting has been carried out by partial charging of oversized boreholes with small-diameter cartridges or tubes. Another approach is the arrangement of spatially separated and individually ignited deck charges at regular intervals in the borehole. The methods are expensive and give little variability in energy output. Frequent problems are inconsistency in charging and uncontrolled coupling between explosive and rock. Detonation failures have also been experienced for certain explosives, supposedly due to precompression from forerunning shock waves in the free gas channel. Introduction of shells or spacers concentric with the charge have improved positioning but added to cost and complicated charging procedure.

To meet the general trend towards wider boreholes and bulk charging of explosives also in connection with careful blasting, bulk explosives of strongly reduced energy concentration have been developed, such as ANFO mixed with porous lightweight material.

The complete fill out of large drill holes with explosive places severe demands for energy reduction and the explosive often approaches its detonation limit. Although the positioning problems mentioned in connection with the packaged products are avoid with bulk explosives, the coupling to the rock surface is stronger and the blast result will be markedly dependent on any inhomogenity present in the explosive. The lightweight materials usually employed for energy reduction are susceptible to static electricity and are not easily mixed with the heavier standard components of the explosive. Precautions taken at manufacture to secure thorough mixing are not sufficient since the components tend to separate during transport and charging operation. The cohesion of ANFO and the possibility to charge in vertical upholes are normally dependent on partial destruction of porous ammonium nitrate prills and the ability of the minor amount of fuel to bridge the so created debris. This ability is strongly reduced by the inclusion of substantial amounts of dry inert fillers and known reduced explosives are of limited use in these applications. Attempts have been made to reduce the abovesaid problems by adding water or adhesive agents to the explosive compositions. Water desensitizes the explosive and can only be used in small amounts. Water is not compatible with either the fuel phase or organic extenders and hence of poor cohesive quality and wetted compositions are not stable over prolonged periods. Adhesive or tackifying additives, as examplified in the British Patent Specification 1 311 077, generally acts as fuel in the explosive and deteriorates the oxygen balance unless the regular fuel amounts is reduced proportionally, in which case a less efficient fuel/oxidizer distribution has to be accepted. Under all circumstances operable amounts are very limited, also for obtaining secondary advantages such as water resistance. Organic additives of this kind may also dissolve, deflate or otherwise adversely effect extenders of organic origin.

SUMMARY OF THE INVENTION

A primary object of the present invention is to provide a blasting composition of reduced and variable strength, which obviates the abovesaid deficiences of hitherto used compositions. More specificly, an object of the invention is provide a bulk composition of this kind, which is easily formed and maintained in homogeneous condition with little or no segregation between its constituents. Another object is to provide a composition of improved coherence, useful for charging in a wide up-holes. Another object is to provide a reduced composition of long term stability. Another object is to provide a composition of within wide limits variable strength and of stable performance also at low energy concentrations. Yet another object is to provide a reduced composition of improved water resistance. Still another object is to provide a reduced composition which will blow-load into bore-hole charges of low density without dusting, component segregation or unintended deposition.

These objects are reached by the features set forth in the appended claims.

By adding a water-in-oil type, fuel and oxidizer containing, emulsion to a particulate mixture of oxidizing salt and energy reducing filler, mixture adhesion can be significantly improved. The emulsion is composed of both a lipophilic fuel phase and a hydrophilic oxidizer phase and efficiently adheres to both the salt and fuel components of the particulate mixture as well as to organic or inorganic fillers. The viscous nature of the emulsion prevents too deep penetration in porous particulate material, ensuring efficient utilization of the emulsion as tackifier while normal performance is maintained for the particulate material. Water-in-oil emulsion consistency rely to a larger extent on volume and disperion ratios between the two phases and only to a lesser extent on material selection, leaving considerable freedom for adaptions between fuel phase and particulate filler. The continuous fuel phase is furthermore sufficiently thin to make acceptable minor incompatibilities, such as slight solubility of the organic filler therein. The inherent conductivity of the emulsion salt solution effecitively prevents static electricity from building up in the composition. The presence of oxidizer in the emulsion reduce interference with the oxygen balance of the composition as a whole, ensuring normal fuel/oxidizer distribution in the particulate material and since the emulsion itself displays an intimate mixture of oxidizer and fuel, the final composition has favourable detonation and sensitivity properties over a wide range of densities and energy concentrations. The oxygen balanced emulsion also allows for inclusion of much larger amounts of additive than would otherwise be possible. Sufficient amounts for reaching the desired cohesive properties can easily be added and also sufficient amounts for promoting secondary advantages such as improved sensitivity and water resistance. The viscous but non-sticky characteristic of the emulsion, acceptable when sufficient amounts can be included, provides for simple manufacture and mixing, good transportability and negligible problems with clogs and deposits in machinery used for manufacture and loading. The additive also serve to moderate particle compaction and tamping, thus promoting final charges of low and consistent density. If the emulsion amount is kept clearly lower than that required for filling the voids and interstices between individual particles of the particulate material, the composition will behave as a substantially dry mixture, which for instance can be blow-loaded into drill holes with normal equipment for ANFO explosives. Yet, the composition will sustain the forces involved without segregation and will adhere well also in vertical upholes.

Further objects and advantages of the invention will be evident from the detailed description hereinbelow.

DEFINITIONS

Relative volume strength, or bulk strength, as used herein shall mean the calculated energy value of a given volume of a composition relative the energy value for an equal volume of straight ANFO, consisting of prilled ammonium nitrate with 5,5 percent by weight of fuel oil, when tamped to a charge density of 0.95 g/cc.

Oxygen balance shall have the conventional meaning of weight difference between chemically available oxygen and oxygen needed for complete combustion of fuels present, expressed as percent of composition total weight.

DETAILED DESCRIPTION OF THE INVENTION

A basic constituent of the present composition is a particulate oxidizer salt, which may be of any suitable compound such as perchlorates or nitrates of ammonia or alcali and alcaline earth metals but is conveniently ammonium nitrate. The structure may be crystalline or that of crushed or ground crystals but preferably the porous prilled type is employed. The porous prills can absorb liquid fuels to form an intimate mixture of fuel and oxidizer and are easily loaded and adhered by slight compaction. The emulsion additive sticks well to the porous prill surface and a low bulk density is better retained by prills than by crystalline solids. For all types, particle size should be fairly large and size distribution narrow. Particle sizes between 0.5 and 10 mm, or better between 1 and 5 mm, are suitable. In general, materials suitable for use in ANFO explosives can also be utilized for the present purposes.

Although other components of the present compositions may have a fuel value sufficient to balance the oxygen content of the oxidizer salt, it is preferred to allow for addition of some fuel directly to the oxidizer salt for best detonation properties. The amount of added fuel may correspond to an oil amount of 1 to 10 percent by weight of the oxidizer salt, or better between 2 and 6 percent by weght. For high contents of combustible fillers the amount may be reduced to between 0 to 4 and preferably between 1 and 3 percent by weight.

Composition bulk strength shall be reduced by addition of a particulate filler or bulking agent. Substantially homogeneous materials of high density can be exploited to provide for high composition density in spite of low strength, e.g. for the purpose of expelling water from drill holes. If density is comparable to that of the particulate oxidizer salt the segregation tendency is initially lowered. The filler mass involved in this case precludes material of high fuel value but inorganic materials may be employed, such as minerals or inert salts of the sodium chloride type. Bulking agents of lower density than the main components are normally preferred. The reduced mass and increased void volume give less cooling and more reliable brisance and propagation. Manufacture, transport and charging are facilitated and compaction of oxidizer salt is reduced. To lower the overall density of the composition it is suitable to employ bulking agents of clearly lower density than the bulk density of the basic components, about 0.8 g/cc. Advantageously the density is also lower than about 0.5 g/cc and more suitably lower than 0.3 g/cc. Since the present invention provides means for preventing segregation also between materials of widely differing densities, the lower density limit is solely determined by the particle strength necessary to resist compaction and ensure low ultimate charge density. Porous inorganic bulking agents are substantially inert and can be used in the present compositions. Typical representatives for this filler category are expanded glasses, perlite, vermiculite, pumicite etc. The low filler mass introduced by lightweight materials permits use of organic materials with a certain fuel value. These materials are normally completely consumed in the detonation reaction and are also attractive for favourable loading characteristics and the very low densities attainable. Organic fillers are available in bulk densities below 0.1 g/cc or even below 0.05 g/cc. Typical products of this kind suitable for the present purposes are expanded polymers of for example vinyl chloride, ethylene, phenol, urethane and especially styrene. Irrespective of material selected, the physical particle shape should be considered. Irregular particles, formed for example in subdivision of porous bulk materials, can be used. Sufficient amounts of the present additive can be included to wet out also these cheaper bulking agents. Regular particles and especially spherical particles, for example produced by expansion of discrete particles of droplets, are preferred. They mix well with other ingredients, require relatively less tackifyer for wetting and adherence and have charging characteristics similar to the oxidizer salt. Also the filler particles should have a narrow size distribution and individual particle sizes within the abovesaid limits. Very satisfactory results have been obtained by spherical porous particles of preexpanded polystyrene foam beads.

The bulking agent shall be added in an amount sufficient to reduce composition volume strength below the volume strength of straight ANFO. To be useful for careful blasting, the relative volume strength should be clearly lower than 100%, say below 80%, better below 60% and preferably also below 40%. With the invention embodied herein the lower limit is mainly restricted by requirements for stable detonation and has to be established by experiments for specific compositions. Although the invention extends the range of useful compositions to lower than ordinary relative volume strengths, a limit can be expected around 5% and customarily the relative volume strength is kept above 10%. These values are merely illustrative as the invention give advantages for all degrees of energy reduction. A specific advantage is the possibility for ready preparation, even on-site, of compositions having widely varying volume strengths. For specific purposes, rock types etc. fine-tuned compositions can be prepared, also close to said range limits.

The water-in-oil type emulsion added to the present compositions have a continuous lipophilic fuel phase and a discontinuous hydrophilic aqueous oxidizer phase. The discontinuous phase contains oxidizer to balance the fuel value of the continuous phase. Preferably sufficient oxidizer is included to give the emulsion as a whole an oxygen balance between −25% and +15%, better between −20% and +10% or substantially balanced. It is preferred to use emulsion compositions, which are explosives per se or would be explosives if properly sensitized with voids etc. in accordance with common practice. Emulsions for this purpose are described in U.S. Pat. No. 3 447 978, or in the British patent specification 1 306 546, both incorporated herein by reference, and in abundant subsequent patents. Such known compositions may be used as disclosed or may form the basis for suitable emulsions when configured with regard to the considerations given herein.

The main components of the oxidizer phase are oxidizing salts similar to those of the particulate oxidizer salt component, such as inorganic nitrates and optionally also perchlorates, dissolved in a small amount of water. Preferably several oxidizing salts are included to attain a high salt concentration in solution. Ammonium nitrate is generally present in addition to alkalli or alkaline earth metal nitrates and perchlorates. The oxidizer phase may contain additives, for example crystallization point depressants such as urea of formamide. When emulsified into discontinuous droplets the oxidizer phase shall be kept above its crystallization temperature but may be supersaturated at ordinary use temperature for the emulsion.

The main part of emulsion fuel phase is a carbonaceous oil, frequently supplemented with wax or other additives such as polymers for the purpose of enhancing viscosity. For the present purposes viscous but non-sticky emulsions are preferred and emulsion fuel phases of high or all oil content have proved effective. In selecting the fuel phase component its compatibility with other ingredients should be evaluated. Organic fillers in particular may be vulnerable to the influence of oils. Deleterious effects can be avoided by selecting an oil of different chemical nature. For polystyrene beads excellent results have been accomplished with oil of low aromatic content, such as vegetable oils, white oils or paraffinic oils.

A water-in-oil type emulsifier is preferably included to facilitate formation and stabilizing the resulting emulsion structure. Common emulsions for the purpose are sorbitan fatty acid esters, glycol esters, unsaturated substituted oxazolines, fatty acid salts and derivates thereof.

Ordinary sensitizers such as void generating material or self-explosive compounds can be included in the emulsion but are preferably omitted as superfluous in view of the other explosive and porous materials present in the reduced blasting composition.

The emulsion is prepared prior to mixing with other ingredients of the blasting composition. Conventional preparation methods can be used in which fuel, emulsifier and oxidizer solution are emulsified in a high shear mixer or a static mixer at a temperature elevated above the softening point for the fuel phase components and the crystallization temperature for the salt solution, followed by cooling to ambient temperature. Both on-site and fixed plant preparation is possible.

The final emulsion can have a conventional composition, e.g. comprising about 3 to 10 percent by weight of fuel including an emulsifier, about 8 to 25 percent by weight of wafer, about 50 to 86 percent by weight of oxidizing salts and possibly other additives in an amount up to about 20 percent by weight, such as an auxiliary fuel or fillers.

By inclusion of sufficient amounts of bulking agent it is possible to obtain compositions of reduced volume strength even with emulsion amounts sufficient for embedding all solids and filling out all interstices therebetween. It is preferred, however, to reduce the amount below this level to thereby secure the presence of voids between the individual particles. It is in general also suitable to reduce the amount to a level insufficient for the formation of a continuous emulsion phase to assure a composition with a behaviour more like a particulate material than a fluid or paste. The amount can be reduced further to give a product only moist or even substantially dry to the touch, whereby manageability and loading properties are further improved. Depending on the characteristics desired in each particular application, variations can be made within these limits. The emulsion adheres and distributes well in the particulate material and compositions of good balance between tack and loading properties will be found within wide limits. As said, free flowing or blowable compositions are of specific utility.

The absolute amount of emulsion required will depend on several conditions, such as type and structure of particulate material selected. Broadly, at least 1% by volume of the total composition bulk volume should be occupied by the emulsion, better at least 2% and preferably at least 3% by volume. The larger amounts give marked improvements in water resistance. Too large volume contents should be avoided and suitably the volume content does not exceed 40%, better does not exceed 25% and preferably does not exceed 10% by volume, calculated as mentioned. The weight ratio between emulsion and particulate oxidizer salt may vary between 10:90 and 60:40, better between 15:85 and 50:50 and is preferably between 20:80 and 45:55.

Preparation and mixing of the ultimate composition can be accomplished in various ways. However, the emulsion should be prepared separately. Similarly, when the particulate oxidizer salt is to be combined with a fuel, it is preferred to pre-mix these ingredients before adding other ingredients. The preferred way of mixing the three main components is to first adhere the emulsion to the oxidizer salt particles by forming a mixture therebetween. This mixing scheme improves water resistance and adherence but is generally not feasable with other types of additives. Mixing at elevated temperature is conceivable, e.g. for emulsions of high viscosity, but preferably emulsions of lower viscosity are cold-mixed with the particulate oxidizer. The particulate bulking agent is then added to the mixture, suitably in increments. Mixing devices of low shear can be used, such as screw mixers or paddle mixers. The preparation process can take place on-site for rapid manufacture of customized compositions adapted to local requirements and for best utilization of composition shelf-life. Although the entire process can be conducted on-site, including emulsion and salt/fuel mixing, it is generally preferred to pre-fabricate these components, especially when it is desirable to cold-mix the emulsion. Composition stability also permits plant-mixing and transport in bulk to the site. Normally the composition are primed although cap-sensitive varieties may be configured.

The compositions of the present invention may be pumped or poured into drill holes and these method are suitable for heavy or wet compositions. As said the compositions embodied herein can be made sufficiently free-flowing or dry for blow-loading, a method competitive in most applications. Conventional methods and devices may be used in this connection, such as blowing from pressurized vessels or blowing with direct injection of pressurized gas or a combination thereof. The compositions easily charge in this way without equipment deposits and sustains the forces involved without segregation, without explosive compaction and with low ultimate volume strength. They easily charge at high rates with a minimum of supervision, personnel and equipment.

An appropriate device for on-site manufacture of tailored compositions may include vessels for pre-mixed emulsion, pre-mixed particulate oxidizer/fuel and particulate bulking agent as well as feeding devices, such as screw or ceil feeders for solids and pumps for emulsion, for mixing the components in variable ratios in an end agitator of abovesaid type, which in turn may discharge into a conventional blow-loader as described.

The proposed compositions may be used whenever a blasting composition with a volume strength reduced in relation to ANFO or whenever a blasting composition with readily variable strength is desired. As said, typical applications are contour blasting or pre-splitting above or underground as well as bench blasting for particular purposes as in crushed stone productions or in quartzite quarrying. Typical bore-hole sizes are from 32 mm and up. Normal bore-hole diameters for careful blasting are between 38 and 51 mm.

In many of such typical applications for the composition of the invention it is desirable to have available on-site, not only the reduced compositions of the invention, but also the stronger explosive components of which the reduced composition may be composed, such as ANFO, a self-explosive water-in-oil type emulsion or a mixture of these. In driving tunnels or galleries, for instance, the contour holes can be charged with the present composition, while the remaining bore-holes may require any of these stronger explosive components.

In designing systems for the on-site preparation of the present compositions, it is a considerable advantage that these compositions may be formed from components useful as such in the charging operations. The system mentioned above, with separate vessels for the three main components, may for example also deliver pure emulsion explosive for maximum water resistance, pure ANFO for good strength to cost performance or mixtures thereof for maximum strength.

A simple system with maintained high flexibility may include a vessel containing the reduced blasting composition of the invention, a vessel containing particulate oxidizer/fuel component and means for selectively discharging the blasting composition, the particulate oxidizer/fuel component or mixtures thereof. Since all these compositions are particulate in nature, very simple means can be used for mixing and discharging and preferably the components are simply blown from their vessels in the desired ratio into a charging hose. Contrary to this, charging of pure emulsion explosives or compositions rich in emulsion may require a separate loading system with pumps or screws and possibly a charging hose lubricated with a water or salt solution ring. Yet the simplifies system allow preparation of compositions ranging from the highly reduced mixtures to the full strength of ANFO.

EXAMPLE 1

An oxidizer phase was prepared from 77.20 parts by weight of ammonium nitrate and 15.80 parts by weight of water. A fuel phase was prepared from 6.12 parts by weight of mineral oil and 0.88 parts emulsifier of substituted succinic anhydride. A water-in-oil type emulsion was formed by mixing the two phase components in a rotating high shear mixer (Votator CR-mixer) at about 80 degrees centrigrade. To 100 parts of this emulsion was added 1 part by weight 0.15 g/cc true density microspheres (C15/250 from 3M) as a sensitizer.

A particulate oxidizer/fuel product was prepared from ammonium nitrate prills of about 0.85 g/cc bulk density with 80 to 90 percent of the particles within 1 to 2 mm size (HE-prills from Dyno Nitrogen AB) supplemented with ordinary fuel oil to 5.5 percent by weight of the oxidizer fuel product.

The cold emulsion was mixed with the solid oxidizer/fuel product in a planetary mixer (Dreiswerk) in a weight ratio of 40% emulsion to 60% solid oxidizer. In the same mixer 98.3 parts by weight of this mixture was mixed with 1.7 parts by weight of expanded polystyrene beads, having a bulk density of about 22 kg/m3 and a fairly uniform particle size of about 2 mm (BASF P402).

The composition obtained had an uncompacted bulk density of about 0.70 g/cc and was blow-loaded into 53 mm steel tubes from a pressurized vessel of a regular commercial charger ("Anol" from Nitro Nobel AB) to a charge density of about 0.72 g/cc. The charge was primed with a 250 gram nitroglycerine based booster (Nobel Prime from Nitro Nobel AB) and shot with detonation velocities between 2832 and 2793 m/sec.

EXAMPLE 2

Example 1 was repeated with the distinction that the weight ratio between emulsion and solid oxidizer/fuel product was altered to 20% emulsion and 80% solid oxidizer and 99.13 parts by weight of this product was mixed with 0.87 parts by weight of the expanded polystyrene beads.

The composition had uncompacted densities between 0.76 and 0.81 g/cc and was blow-loaded to a density of about 0.78 g/cc and shot with velocities between 2915 and 2849 m/sec.

EXAMPLE 3

Example 2 was repeated with the distinction that 89.3 parts by weight of the 20% emulsion/80% solid oxidizer/fuel product was mixed with 10.7 parts by weight of the expanded polystyrene beads. The composition had an uncompacted density of about 0.18 g/cc and was blow-loaded into 41.5 mm steel tubes to a charge density of about 0.28 g/cc and shot with a velocity of 1781 m/sec. The same composition charged into the 53 mm steel tubes shot with a velocity of 1783 m/sec.

EXAMPLE 4

Example 2 was repeated with the distinction that 92 parts by weight of the 20% emulsion/80% solid oxidizer/fuel product was mixed with 8 parts by weight of the polystyrene beads. The composition had an uncompacted density of about 0.23 g/cc and was blow-loaded into 41.5 mm steel tubes to a charge density of about 0.22 g/cc and shot with velocities between 2186 and 1692 m/sec. When charged into 53 mm steel tubes, charge densities of 0.33 and velocities between 2532 and 1789 m/sec were obtained.

EXAMPLE 5

Example 1 was repeated with the distinction that 92 parts by weight of the 40% emulsion/60% solid oxidizer/fuel product was mixed with 8 parts by weight of the expanded polystyrene beads. The composition had an uncompacted density of 0.22 g/cc and was blow-loaded into 41.5 mm steel tubes to a charge density of about 0.26 g/cc and shot with velocities between 1857 and 2037 m/sec. When charged into 53 mm steel tubes charge densities of 0.25 g/cc and detonation velocities between 1936 and 2070 m/sec were obtained.

EXAMPLE 6

The composition of Example 5 (i.e. the composition of Example 1 modified to a 8/92 weight ratio between polystyrene beads and emulsion/oxidizer product was stored in bulk for about two months. The composition was substantially free-flowing and was blow-loaded into 41 mm steel tubes to a charge density of 0.26 g/cc and shot with velocities between 1894 and 2026 m/sec.

EXAMPLE 7

Example 6 was repeated with an additional storage, after bulk storage, of the charged explosive for one week after charging. Charge density was about 0.26 g/cc and detonation velocity between 1894 and 2026 m/sec.

EXAMPLE 8

In a tunnel with a pre-cut central channel, four horizontal roof contour holes and four horizontal floor contour holes were driven, all with a length of 3 m and a diameter of 43 mm. Central spacing was about 0.5 m and burden within 0.3 and 0.6 m. The drill holes were charged with the composition of Example 5 to a density of about 0.26 after immersion of water in one of the floor holes to about a third of its volume. The charges were primed as in Example 1 and shot about 45 minutes after loading and water exposure. Detonation velocity was established to 1827 m/sec for one of the dry roof-holes and to 515 m/sec for the wet floor hole. Throughout bore-hole length, the blast left clean cut surfaces with readily visible simicircular drill-hole profile remnants.

Claim:

1. A method for the production or delivery of a reduced volume strength blasting composition, comprising the steps of:

a) preparing a particulate blasting composition, having a volume strength relative to standard ANFO reduced to below 80%, said standard ANFO consisting of prilled ammonium nitrate with 5.5 percent by weight of fuel oil and tamped to a charge density of 0.95 g/cc, by mixing:
   (i) a particulate oxidizing salt;
   (ii) an energy reducing inert or density reducing filler or mixture thereof effective to produce reduced volume strength; and
   (iii) a viscous water-in-oil type emulsion, having a continuous fuel phase and a discontinuous aqueous phase comprising dissolved oxidizing salts;

b) preparing a particulate oxidizer/fuel component; and c) mixing said reduced particulate blasting composition and said oxidizer/fuel component, thereby producing said blasting composition, wherein said blasting composition has a reduced volume strength relative to standard ANFO.

2. The method of claim 1, wherein the particulate oxidizer salt is porous prills.

3. The method of claim 1, wherein the particulate oxidizer salt includes a liquid fuel in an amount between 1 and 10 percent by weight of the mixture.

4. The method of claim 1, wherein the particulate filler is porous particles of a size comparable to the particulate oxidizer salt particles.

5. The method of claim 1, wherein the particulate filler has a bulk density lower than the bulk density of the particulate oxidizer salt.

6. The method of claim 5, wherein the particulate filler is expanded polystyrene beads.

7. The method of claim 1, wherein the water-in-oil type emulsion has a fuel phase without or with only minor amounts of solid fuels.

8. The method of claim 1, wherein the volume strength of the blasting composition relative to ANFO is between 5 and 80 percent.

9. The method of claim 1, wherein the bulk volume content of the water-in-oil type emulsion is between 1 and 40 percent.

10. The method of claim 1, wherein the mass ratio between the water-in-oil type emulsion and the particulate oxidizer salt is less than 60:40.

11. The method of claim 1, wherein said reduced volume strength blasting composition is substantially free of segregation of components.

12. The method of claim 1, wherein said preparation step a) includes mixing a fuel for modifying the oxygen balance.

13. The method of claim 1, wherein the particulate oxidizer fuel component prepared in step b) is ANFO.

14. The method of claim 1, wherein said mixing step a) is performed by blowing the components into a charging hose.

15. The method of claim 1, wherein the reduced blasting composition and the oxidizer/fuel component are pre-fabricated and mixing step c) is performed on-site.

* * * * *